US011254131B2

(12) United States Patent
Hayashi

(10) Patent No.: US 11,254,131 B2
(45) Date of Patent: Feb. 22, 2022

(54) LIQUID DISCHARGE HEAD

(71) Applicant: BROTHER KOGYO KABUSHIKI KAISHA, Nagoya (JP)

(72) Inventor: Hideki Hayashi, Nagoya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 10 days.

(21) Appl. No.: 16/665,225

(22) Filed: Oct. 28, 2019

(65) Prior Publication Data

US 2020/0189274 A1 Jun. 18, 2020

(30) Foreign Application Priority Data

Dec. 18, 2018 (JP) ..... JP2018-236573

(51) Int. Cl.
*B41J 2/14* (2006.01)
*B41J 2/18* (2006.01)
*B41J 2/155* (2006.01)

(52) U.S. Cl.
CPC ..... *B41J 2/1433* (2013.01); *B41J 2/155* (2013.01); *B41J 2/18* (2013.01); *B41J 2002/14241* (2013.01); *B41J 2002/14419* (2013.01); *B41J 2002/14459* (2013.01); *B41J 2002/14491* (2013.01); *B41J 2202/08* (2013.01); *B41J 2202/12* (2013.01); *B41J 2202/18* (2013.01)

(58) Field of Classification Search
CPC ..... B41J 2/14233; B41J 2/1433; B41J 2/155; B41J 2/175; B41J 2/18; B41J 2002/14241; B41J 2002/14459; B41J 2002/14491; B41J 2202/08; B41J 2202/12; B41J 2202/18
See application file for complete search history.

(56) References Cited

U.S. PATENT DOCUMENTS 7,850,290 B2 * 12/2010 Nitta ..... B41J 2/17556 347/85
9,085,164 B2 * 7/2015 Domae ..... B41J 2/175
2008/0238980 A1 * 10/2008 Nagashima ..... B41J 2/14233 347/17
2010/0328409 A1 * 12/2010 Matsufuji ..... B41J 2/14233 347/93

(Continued)

FOREIGN PATENT DOCUMENTS

JP 2017-136822 A 8/2017

*Primary Examiner* — Anh T Vo
(74) *Attorney, Agent, or Firm* — Scully, Scott, Murphy & Presser, P.C.

(57) ABSTRACT

A liquid discharge head includes: individual channel rows; a common channel; a supply port via which liquid is supplied to the common channel; and a discharge port via which the liquid is discharged from the common channel. Each of the individual channel rows is formed of individual channels aligned in a first direction, each of the individual channels includes a nozzle, and the individual channel rows are arranged in a second direction crossing the first direction. The common channel extends in the first direction, and extends in the second direction over an entire length of an area in which the individual channel rows are arranged. The common channel overlaps with the individual channel rows in a third direction orthogonal to both of the first and second directions, and communicates with the individual channels constructing each of the individual channel rows.

16 Claims, 14 Drawing Sheets

(56) References Cited

U.S. PATENT DOCUMENTS

| | | | | |
|---|---|---|---|---|
| 2012/0062659 | A1* | 3/2012 | Tsubaki ..... | B41J 2/17509<br>347/85 |
| 2017/0217176 | A1 | 8/2017 | Sato et al. | |
| 2017/0217197 | A1 | 8/2017 | Kanegae et al. | |
| 2017/0217199 | A1 | 8/2017 | Yamagishi et al. | |

* cited by examiner

LIQUID DISCHARGE HEAD

CROSS REFERENCE TO RELATED APPLICATION

The present application claims priority from Japanese Patent Application No. 2018-236573 filed on Dec. 18, 2018, the disclosure of which is incorporated herein by reference in its entirety.

BACKGROUND

Field of the Invention

The present disclosure is related to a liquid discharge head which discharges liquid from nozzles.

Description of the Related Art

As a liquid discharge head which discharges liquid from nozzles, there is a known liquid jetting head which jets or discharges ink from nozzles. In this known liquid jetting head, two individual channel rows, each of which is formed by aligning individual flow channels (channels) including nozzles and pressure chambers in a Y direction, are arranged in a X direction. Further, common liquid chambers are arranged, respectively, at locations above the two individual channel rows. The ceiling surface of each of the common liquid chambers is provided with an inflow port arranged in one end part in the X direction, of the ceiling surface, and a discharge port (exhaust port) arranged in the other end part in the X direction of the ceiling surface.

SUMMARY

Here, in the above-described liquid jetting head, the common liquid chambers are arranged, respectively, at the locations above the individual channel rows, and the inflow port and the discharge port are provided on each of the common liquid chambers. Namely, the two inflow ports and the two discharge ports are provided with respect to the two individual channel rows. In this case, flow channels via which the liquid is supplied are connected to the two inflow ports, respectively; and flow channels via which the liquid is discharged (exhausted) are connected to the two discharge ports, respectively.

Thus, there is such a fear that the configurations of the flow channels connected to the common liquid chambers might be complex. Further, for example, for a purpose of avoiding any interference between the flow channels connected to the two inflow ports, any interference between the flow channels connected to the two discharge ports, and any interference between the flow channels connected to the two inflow ports and the flow channel connected to the two discharge ports, it is necessary that the inflow ports, the discharge ports, and the inflow ports and the discharge ports are arranged to be apart from one another to a certain extent. Therefore, in the above-described liquid jetting head having the two inflow ports and the two discharge ports, the degree of freedom in arranging the inflow ports and the discharge ports is low.

An object of the present disclosure is to provide a liquid discharge head which is capable of simplifying the configuration of flow channels connected to a common flow channel (common channel) and in which the degree of freedom in arranging a supply port and a discharge port provided on the common channel is high.

According to an aspect of the present disclosure, there is provided a liquid discharge head including: individual channel rows, each of the individual channel rows being formed of individual channels aligned in a first direction, each of the individual channels including a nozzle, and the individual channel rows being arranged in a second direction crossing the first direction; a common channel extending in the first direction, the common channel overlapping with the individual channel rows in a third direction orthogonal to both of the first and second directions, the common channel extending in the second direction over an entire length of an area in which the individual channel rows are arranged, the common channel communicating with the individual channels constructing each of the individual channel rows; a supply port via which liquid is supplied to the common channel; and a discharge port via which the liquid is discharged from the common channel.

DESCRIPTION OF THE EMBODIMENTS

In the following, an embodiment of the present disclosure will be explained.

Overall Configuration of Printer 1

Figure 1:
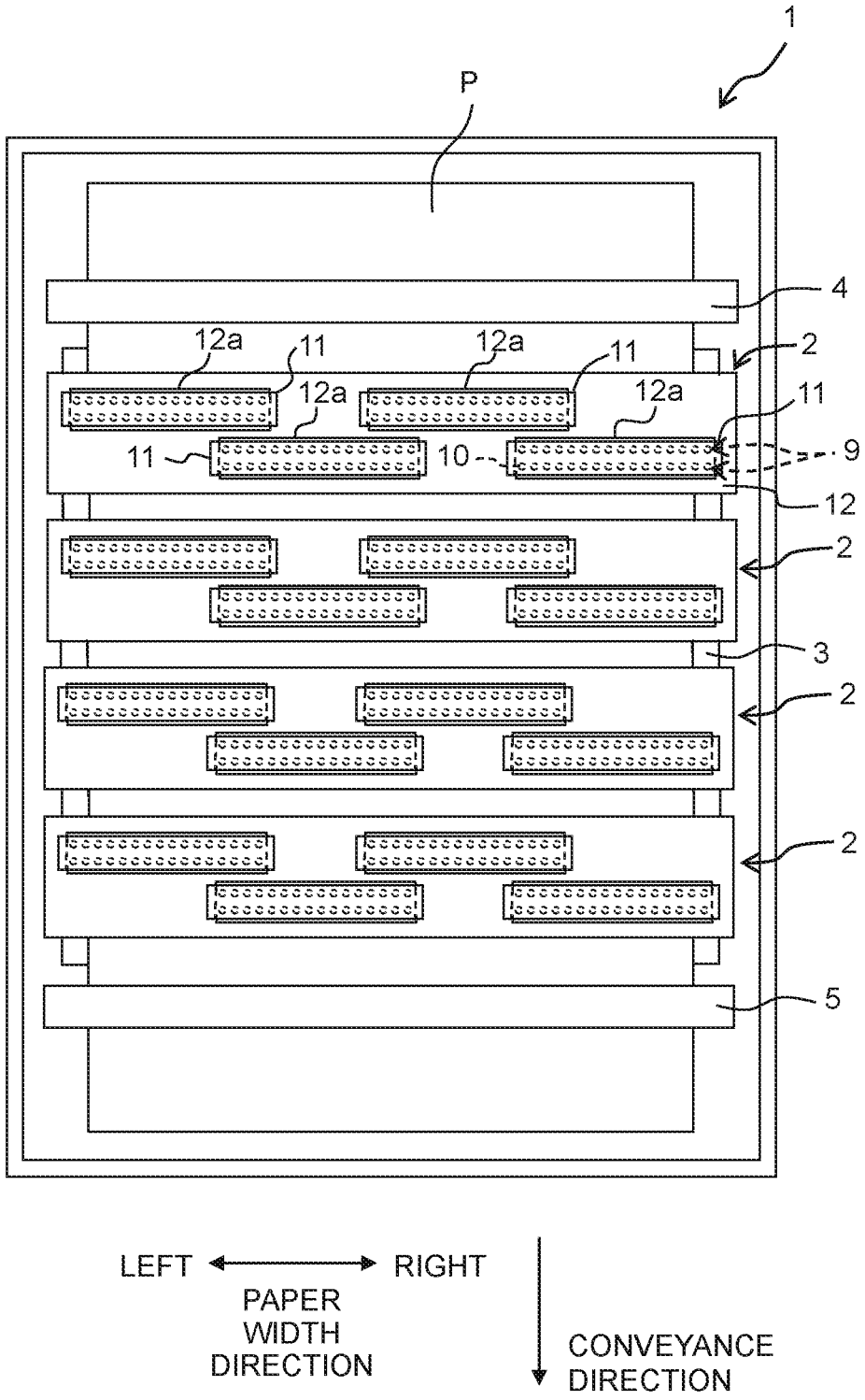
FIG. 1 is a schematic view depicting the configuration of a printer according to an embodiment of the present disclosure.
Figure 2:
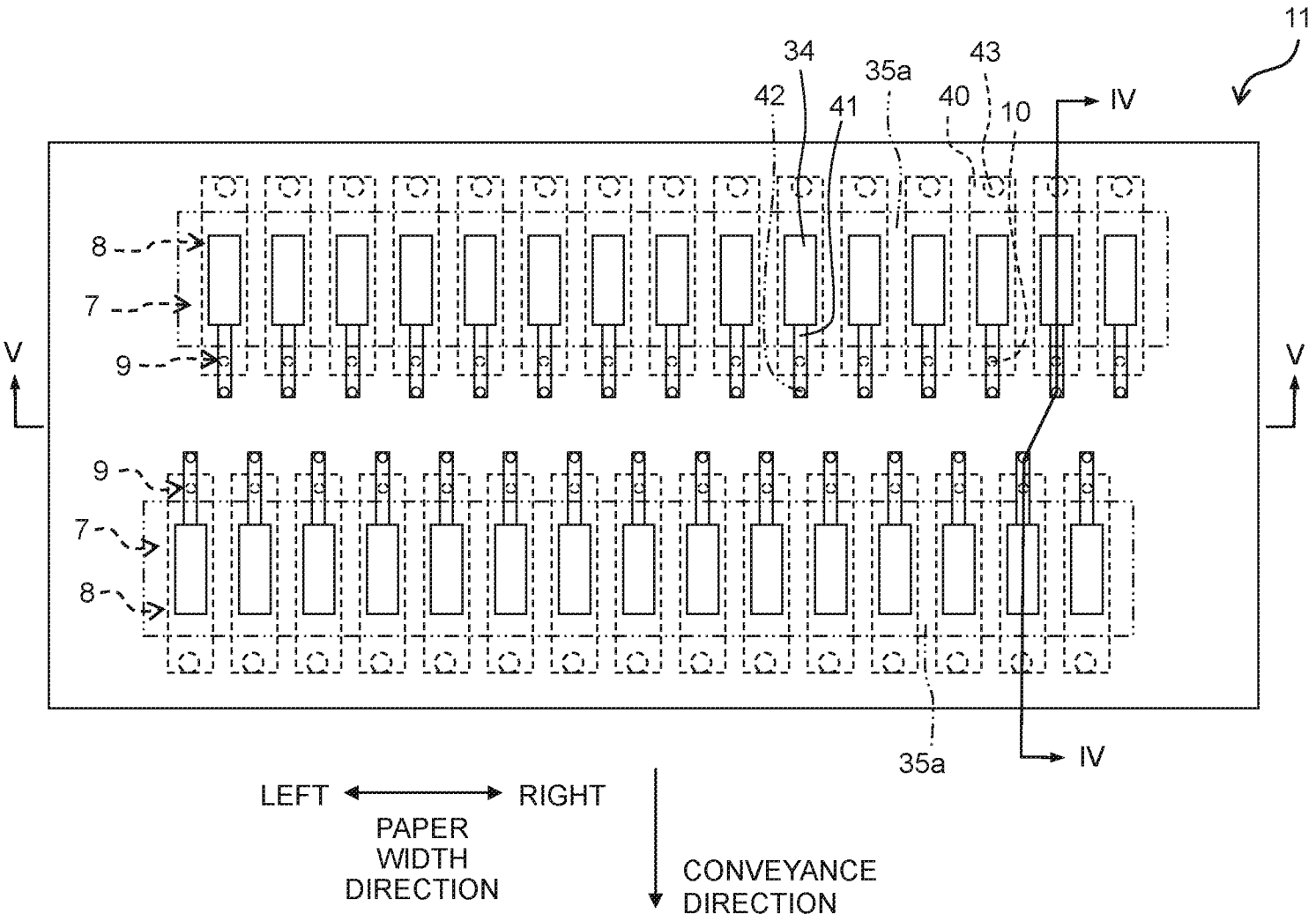
FIG. 2 is a plan view of a part, of a head unit, located blow a protective substrate.

As depicted in FIG. 1, a printer 1 according to the present embodiment is provided with four ink-jet heads 2, a platen 3 and conveying rollers 4 and 5.

The four ink-jet heads 2 are arranged side by side in a conveyance direction (corresponding to a "second direction" of the present disclosure) which is horizontal and in which a recording paper sheet (recording paper) P is conveyed by the conveying rollers 4 and 5 as will be described later on; each of the four ink-jet heads 2 is provided with four head units 11 (corresponding to a "liquid discharge head" of the present disclosure), and a holding member 12. Each of the head units 11 discharges or jets an ink from a plurality of nozzles 10 formed in a lower surface thereof. Here, as the ink discharged from the plurality of nozzles 10 of the head unit 11, black, yellow, cyan and magenta inks are discharged, in this order from the upstream side in the conveyance direction, respectively from the plurality of nozzles 10 constructing the four ink-jet heads 2 which are arranged side by side in the conveyance direction.

Further, in the head units 11, the plurality of nozzles 10 are aligned in a paper width direction (corresponding to a "first direction" of the present disclosure) which is horizontal and orthogonal to the conveyance direction to thereby form a nozzle row 9. Furthermore, each of the head units 11 has two nozzle rows 9 arranged side by side in the conveyance direction. Moreover, in the two nozzle rows 9, the positions of the nozzles 10 in the paper width direction are shifted by half a spacing distance (interval) between the nozzles 10 in each of the nozzle rows 9. Note that the following explanation will be made, with the right side and the left side in the paper width direction being defined as depicted in FIG. 1.

Further, in each of the ink-jet heads 2, two head units 11 among the four head units 11 are arranged side by side in the paper width direction at a spacing distance (interval) therebetween; remaining two head units 11 among the four head units 11 are arranged side by side in the paper width direction at a spacing distance therebetween. Furthermore, among the four head units 11, the two head units 11 arranged side by side in the paper width direction and the remaining two head units 11 arranged side by side in the paper width direction are arranged side by side in the conveyance direction at an interval therebetween. Moreover, the two head units 11 arranged on the upstream side in the conveyance direction and the two head units 11 arranged on the downstream side in the conveyance direction are arranged so that the positions in the paper width direction thereof are shifted. Further, a part of the nozzles 10 in each of the two head units 11 arranged on the upstream side in the conveyance direction is overlapped with a part of the nozzles 10 in one of the two head units 11 arranged on the downstream side in the conveyance direction. With this, the plurality of nozzles 10 of the four head units 11 are arranged in the paper width direction over the entire length of the recording paper P. Namely, each of the ink-jet heads 2 is a so-called line head extending in the paper width direction over the entire length of the recording paper P. Note that the detailed configuration of each of the head units 11 will be explained later on.

The holding member 12 is a plate-like member of which shape is a rectangular and of which longitudinal direction is the paper width direction; the four head units 11 are fixed to the holding member 12. Further, the holding member 12 is formed with four through holes 12*a* having a rectangular shape and corresponding to the four head units 11, respectively. The plurality of nozzles 10 in the four head units 11 are exposed to the lower side (the side of the recording paper P) via the four through holes 12*a*, corresponding thereto respectively.

The platen 3 is arranged below the four ink-jet heads 2, and faces (is opposite to) the plurality of nozzles 10 of each of the four ink-jet head 2. The platen 3 supports the recording paper P from therebelow. The conveying roller 4 is arranged on the upstream side in the conveyance direction of the four ink-jet heads 2 and the platen 3. The conveying roller 5 is arranged on the downstream side in the conveyance direction of the four ink-jet heads 2 and the platen 3. The conveying rollers 4 and 5 convey the recording paper P in the conveyance direction.

Further, in the printer 1, recording is performed with respect to the recording paper P by discharging (jetting) the ink from the plurality of nozzles 10 of the four ink-jet heads 2 toward the recording paper P, while conveying the recording paper P in the conveyance direction by the conveying rollers 4 and 5.

Head Unit 11

Next, the head units 11 will be explained. As depicted in FIGS. 2 to 5, each of the head units 11 is provided with a nozzle plate 31, a flow channel substrate 32 (corresponding to a "pressure chamber member" of the present disclosure), a vibration plate 33, a plurality of piezoelectric elements 34, a protective substrate 35 (corresponding to a "protective member" of the present disclosure), a driver IC 36, plates 37 and 38, and a common channel member 39. Note that in FIG. 3, a common channel 45 (which is to be described later on) formed in the common channel member 39 is depicted together with the nozzles 10, pressure chambers 40 and throttles 43 (which are to be described later on) and the driver IC 36 formed in another member different from the common channel member 39, so that the positional relationship between individual channels 20 (which are to be described later on) and the common channel 45 are easily understood.

The nozzle plate 31 is formed, for example, of a synthetic resin material. The nozzle plate 31 has the plurality of nozzles 10. The plurality of nozzles 10 construct the above-described two nozzle rows 9.

The flow channel substrate 32 is formed, for example, of silicon (Si) and is arranged on the upper surface of the nozzle plate 31. The flow channel substrate 32 has a plurality of pressure chambers 40. The plurality of pressure chambers 40 correspond to the plurality of nozzles 10, respectively; each of the plurality of pressure chambers 40 overlaps, in an up-down direction, with a certain nozzle 10 included in the plurality of nozzles 10 and corresponding thereto. To provide more detailed explanation, each of pressure chambers 40 which are included in the plurality of pressure chambers 40 and which construct a pressure chamber row 8 on the upstream side in the conveyance direction overlaps in an up-down direction, at an end thereof on the downstream side in the conveyance direction, with one of the nozzles 10. Further, each of pressure chambers 40 which are included in the plurality of pressure chambers 40 and which construct a pressure chamber row 8 on the downstream side in the conveyance direction each overlaps in an up-down direction, at an end thereof on the upstream side in the conveyance direction, with one of the nozzles 10. With this, the plurality of pressure chambers 40 are aligned in the paper width direction to thereby form the pressure chamber row 8; the channel substrate 32 has two pressure chamber rows 8 arranged side by side in the conveyance direction.

The vibration plate 33 is composed, for example, of silicon dioxide ($SiO_2$), silicon nitride (SiN), etc. The vibration plate 33 is formed by oxidizing or nitriding an upper part of the flow channel substrate 32, and covers the plurality of pressure chambers 40.

The plurality of piezoelectric elements 34 are provided with respect to and corresponding to the plurality of pressure chambers 40, respectively. Each of the plurality of piezoelectric elements 34 is arranged in a part, of the upper surface of the vibration plate 33, overlapping in the up-down direction with a pressure chamber 40 which is included in the plurality of pressure chambers 40 and which corresponds thereto. Here, each of the plurality of piezoelectric elements 34 is provided with a piezoelectric body formed of a piezoelectric material containing, as a main component thereof, lead zirconate titanate which is a mixed crystal of lead titanate and lead zirconate, an electrode, etc. Further, the piezoelectric body in a piezoelectric element 34 is piezoelectrically deformed to thereby deform the piezoelectric element 34 and a part of the vibration plate 33 which overlaps with a pressure chamber 40 corresponding to the piezoelectric element 34 in the up-down direction so as to project toward the pressure chamber 40. As a result, the volume of the pressure chamber 40 becomes small, which in turn applies the pressure to the ink inside the pressure chamber 40, thereby discharging the ink from a nozzle 10 corresponding to the pressure chamber 40. Note that the construction and the operation of the piezoelectric element 34 are similar to those of a conventional piezoelectric element, and thus any further detailed explanation therefor will be omitted. In the present embodiment, the part, of the vibration plate 33, overlapping with each of the pressure chambers 40 in the up-down direction and each of the piezoelectric elements 34 are collectively correspond to an "actuator" of the present disclosure.

The protective substrate 35 is formed, for example, of silicon (Si), and is arranged on the upper surface, of the vibration plate 33, on which the plurality of piezoelectric elements 34 are arranged. Two recessed parts 35*a* are formed in the lower surface of the protective substrate 35. The two recessed parts 35*a* correspond to the two pressure chamber rows 8, respectively. Each of the recessed parts 35*a* extends in the paper width direction over the pressure chambers 40 constructing one of the two pressure chamber rows 8 corresponding to each of the two recessed parts 35*a*, and covers the piezoelectric elements 34 corresponding to the pressure chambers 40, respectively.

The driver IC 36 is arranged on the upper surface, of the protective substrate 35, at a central part thereof in the conveyance direction. The plurality of piezoelectric elements 34 and the driver IC 36 are connected to each other via a plurality of wires 41 and a plurality of wires 42. Each of the plurality of wires 41 is arranged on the upper surface of the vibration plate 33, is connected to one of the plurality of piezoelectric elements 34 corresponding thereto, and is drawn from a connection part with the piezoelectric element 34 toward an inner side in the conveyance direction of the head unit 11. Each of the plurality of wires 42 is formed in the inside of the protective substrate 35, extends in the up-down direction, and connects the driver IC 36 with an end part, of one of the plurality of wires 42 corresponding thereto, which is on the side opposite to the plurality of piezoelectric elements 34.

The plate 37 is formed, for example, of silicon (Si), and is arranged on the upper surface of the protective plate 35 on which the driver IC 36 is arranged. The plate 37 is formed with a through hole 37*a* in a part, of the plate 37, including a central part in the conveyance direction. Further, the driver IC 36 arranged on the upper surface of the protective substrate 35 is accommodated in the inside of the through hole 37*a*, and is positioned at the central part in the conveyance direction of the through hole 37*a*.

The plate 38 is formed of a metallic material such as SUS, etc., and is arranged on the upper surface of the plate 37 and covers the through hole 37*a*. Further, a heat-conductive plate 29 (corresponding to a "heat-conductive member" of the present disclosure) formed of a metallic material, etc., is arranged between the driver IC 36 and the plate 38 in the up-down direction. The lower surface of the heat-conductive plate 29 makes contact with the driver IC 36, and the upper surface of the heat-conductive plate 29 is joined to the plate 38. Further, parts, of the plate 38, which overlap with the through hole 37*a* in the up-down direction and which are located on the both sides of the heat-conductive plate 29 in the conveyance direction are formed with recessed parts 38*a*, which are open in the lower surface of the plate 38. Furthermore, parts, of the plate 38, located above the recessed parts 38*a* are dampers 38*b* of which thickness is thinned and which are elastically deformable.

The common channel member 39 is formed, for example, of a synthetic resin material, and is arranged on the upper surface of the plate 38. A common channel 45 is formed in the common channel member 39. The common channel 45 has a shape which, as viewed in the up-down direction, is a rectangle long in the paper width direction, and extends, in the conveyance direction, over the entire length of an area wherein the two pressure chamber rows 8 are arranged. Further, the common channel 45 extends, in the paper width direction, over the entire length of the two pressure chamber rows 8. With this, the common channel 45 overlaps, in the up-down direction, with all the pressure chambers 40 constructing the two pressure chamber rows 8. Furthermore, the plate 38 forms a lower wall of the common channel 45; the dampers 38*b* formed by the plate 38 are elastically deformed to thereby suppress any fluctuation or variation in pressure of the ink inside the common channel 45.

Note that in the present embodiment, the plate 38 which forms the lower inner wall surface of the common channel 45 has the part making contact with the driver IC 36 via the heat-conductive plate 29 (corresponding to a "wall part" of the present disclosure) and the two dampers 38*b* (corresponding to "two damper members" of the present disclosure). Namely, in the present embodiment, the plate 38 is constructed of the "wall member" and the "two damper members" of the present disclosure which are combined as an integrated body.

Further, a supply channel 46 and a discharge channel 47 are formed in the common channel member 39. The supply channel 46 overlaps, in the up-down direction, with a central part in the conveyance direction of a right end part (corresponding to an "end part on the one side") in the paper width direction of the common channel 45 in the common channel member 39. The supply channel 46 extends in the up-down direction, and a lower end of the supply channel 46 becomes a supply port 46*a* which is opened, in a ceiling surface 45*a* of the common channel 45, in a central part in the conveyance direction of a right end part in the paper width direction of the ceiling surface 45*a*.

The supply channel 46 is connected to an ink tank 50 via a non-depicted ink channel. The ink tank 50 is connected to a non-depicted ink cartridge via a non-depicted tube, etc., and the ink is supplied from the ink cartridge to the ink tank 50. Further, a pump 51 is provided on a channel between the supply channel 46 and the ink tank 50. The pump 51 feeds the ink from the ink tank 50 toward the supply channel 46.

The discharge channel 47 overlaps, in the up-down direction, with a central part in the conveyance direction of a left end part (corresponding to an "end part on the other side") in the paper width direction of the common channel 45 in the common channel member 39. The discharge channel 47 extends in the up-down direction, and a lower end of the discharge channel 47 becomes a discharge port 47*a* which is opened, in the ceiling surface 45*a* of the common channel 45, in a central part in the conveyance direction of a left end part in the paper width direction of the ceiling surface 45*a*.

The discharge channel 47 is connected to the ink tank 50 via a non-depicted ink channel. Further, a pump 52 is provided on a channel between the discharge channel 47 and the ink tank 50. The pump 52 feeds the ink from the discharge channel 47 toward the ink tank 50.

Figure 4:
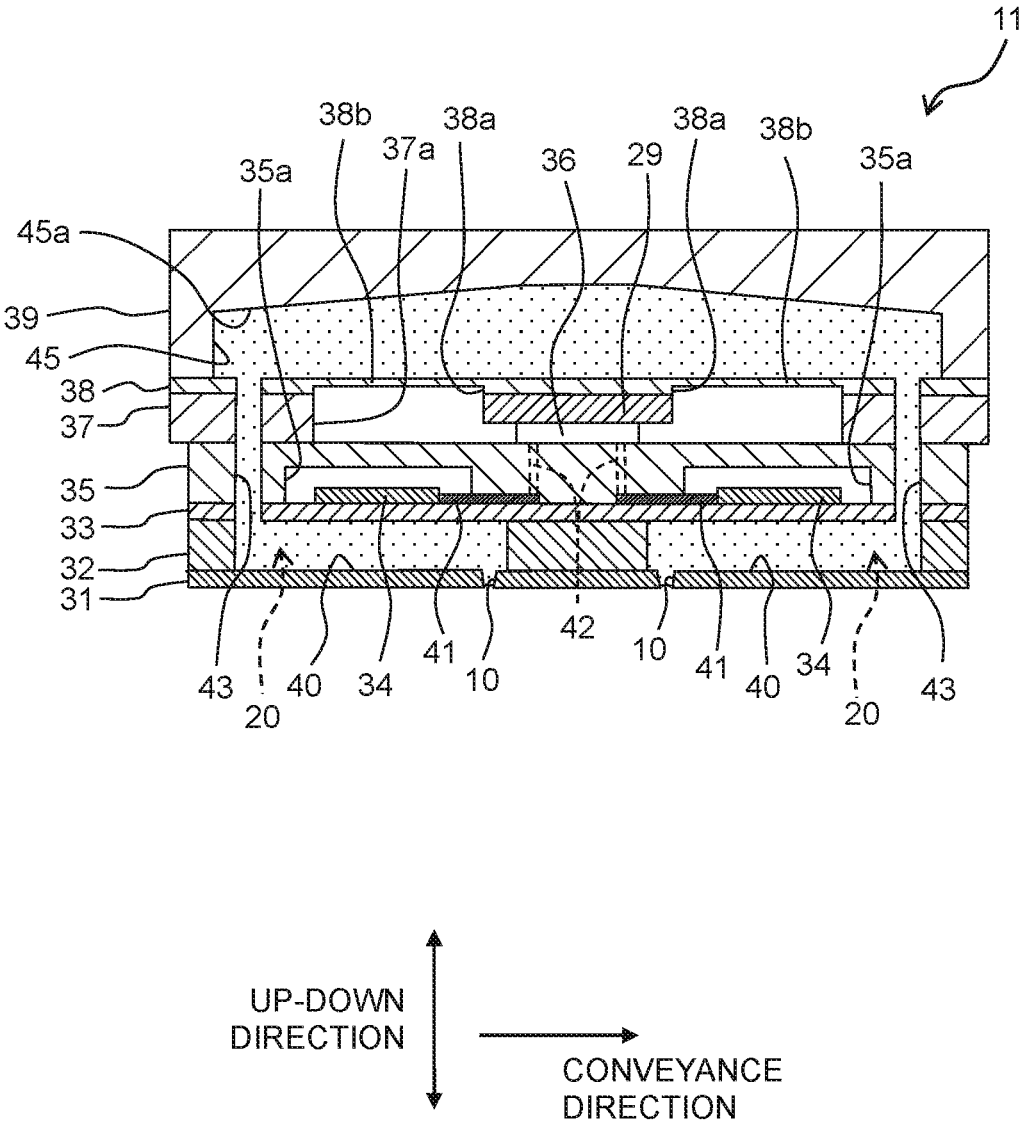
FIG. 4 is a cross-sectional view of the head unit taken along a line IV-IV in FIGS. 2 and 3.
Figure 5:
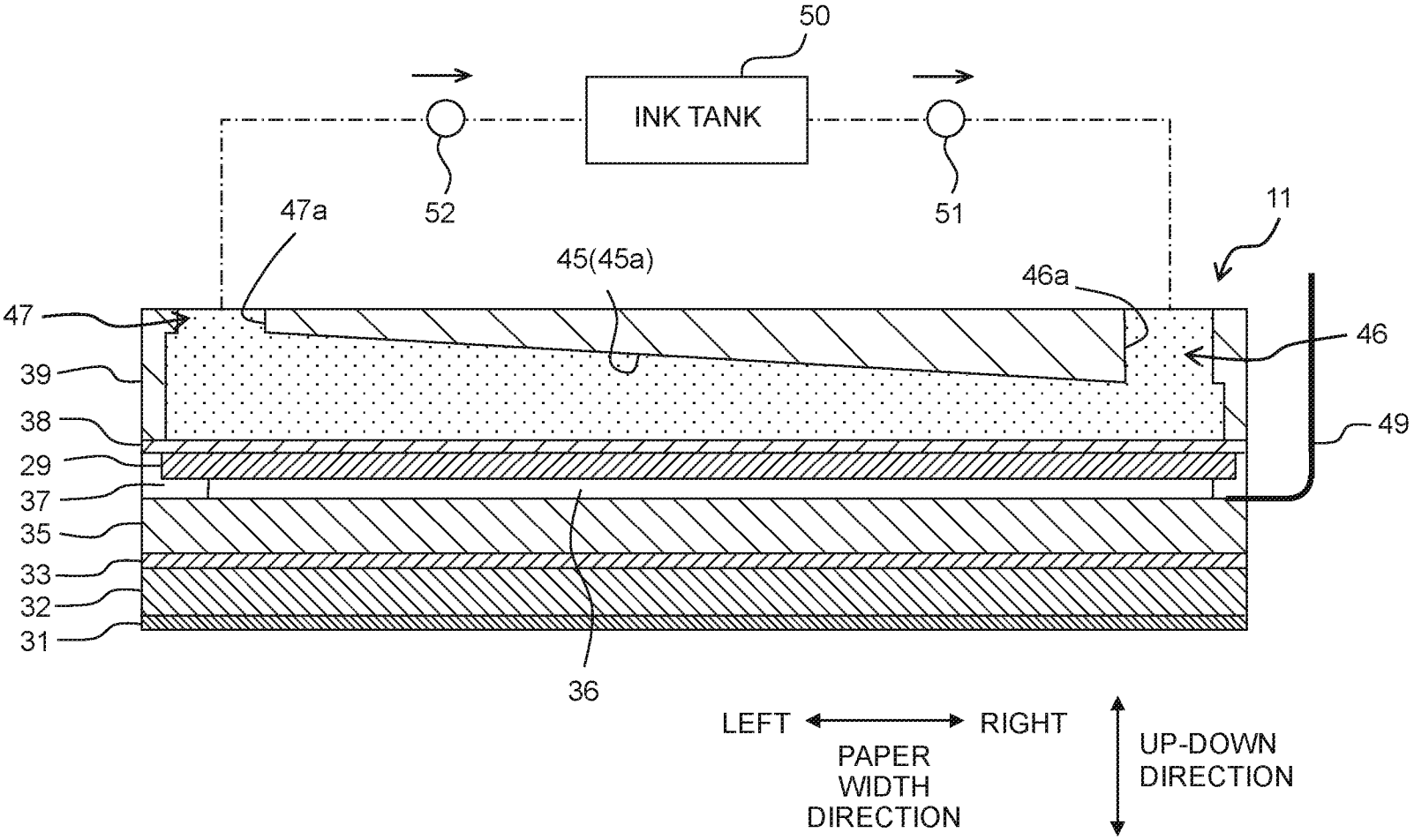
FIG. 5 is a cross-sectional view of the head unit taken along a line V-V in FIGS. 2 and 3.

Furthermore, as depicted in FIG. 5, the ceiling surface 45*a*, of the common channel 45, in which the supply channel 46 and the discharge channel 47 are arranged, is inclined with respect to a horizontal plane (plane parallel to the paper width direction and the conveyance direction) upward as approaching from the right side toward the left side in the paper width direction (as approaching from the supply port 46 toward the discharge port 47). Moreover, as depicted in FIG. 4, the ceiling surface 45*a* is inclined with respect to the horizontal plane upward as approaching from the outer side toward the inner side in the conveyance direction of the head unit 11.

Figure 3:
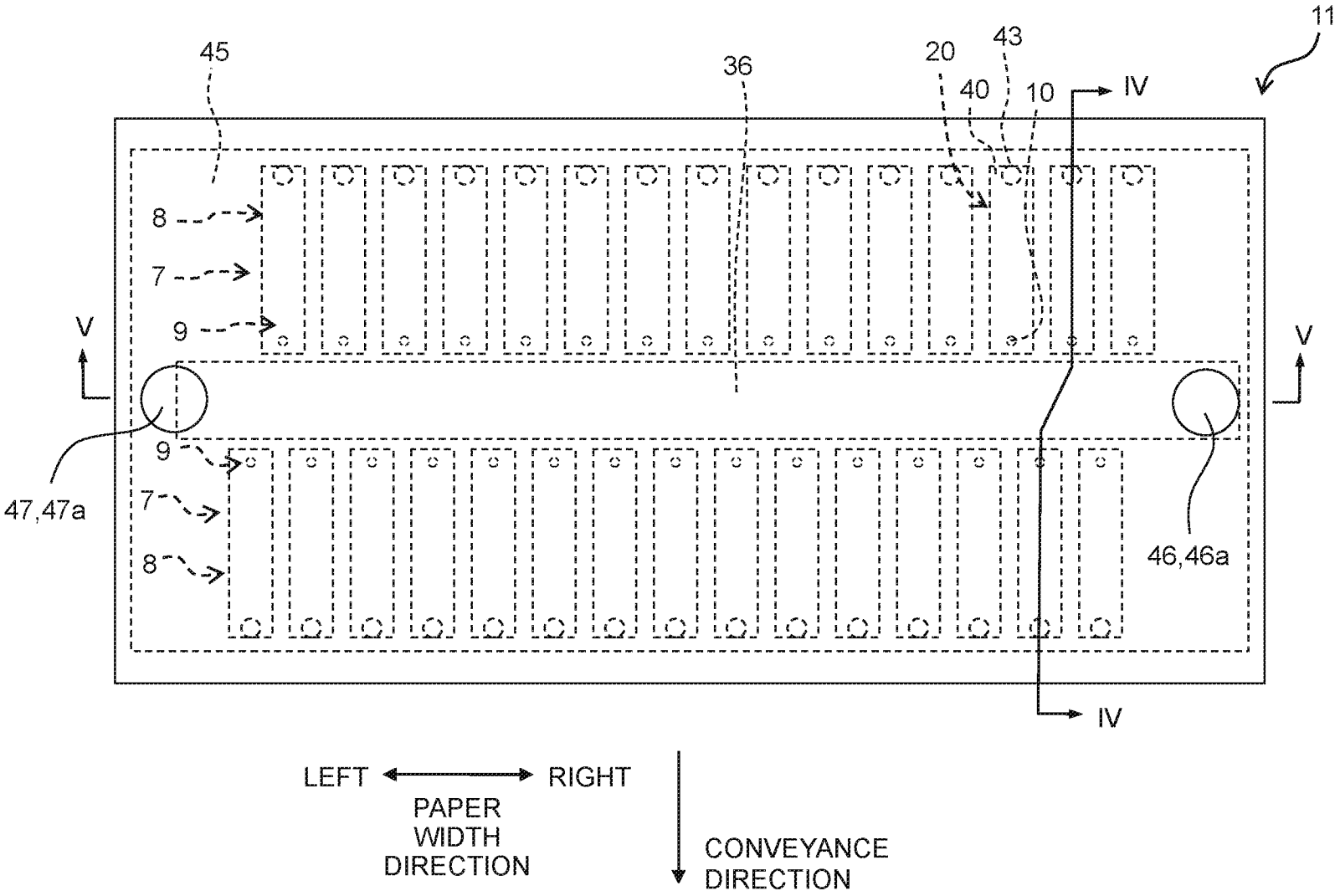
FIG. 3 is a plan view of a common channel member.

Further, as depicted in FIG. 3, the above-described driver IC 36 extends to the right side in the paper width direction, up to a position at which the driver IC 36 overlaps with the supply channel 46 in the up-down direction, and extends to the left side in the paper width direction, up to a position at which the driver IC 36 overlaps with the discharge channel 47 in the up-down direction. Furthermore, the driver IC 36 is connected, via a non-depicted wiring arranged on the upper surface of the protective substrate 35, to a wiring member 49 (see FIG. 5) joined to the upper surface of the protective substrate 35. The wiring member 49 is drawn to the right side in the paper width direction, then extends upwardly, and is connected to a non-depicted substrate.

Moreover, the head unit 11 has a plurality of throttles 43. The plurality of throttles 43 correspond to the plurality of pressure chambers 40, respectively. Each of the plurality of throttles 43 overlaps, in the up-down direction, with an end part, of one of the pressure chambers 10 corresponding thereto, on a side opposite to the nozzles 10 in the conveyance direction. Each of the plurality of throttles 43 extends while penetrating through the vibration plate 33, the protective substrate 35, the plates 37 and 38 in the up-down direction, so as to connect the common channel 45 with one of the pressure chambers 10 corresponding to each of the plurality of throttles 43. With this, the ink inside the common channel 45 is supplied to each of the plurality of pressure chambers 40 via one of the plurality of throttles 43.

Further, an individual channel 20 is formed of one piece of the nozzle 10, and one piece of the pressure chamber 40 and one piece of the throttle 43 corresponding to one piece of the nozzle 10. Furthermore, in the head unit 11, a plurality of pieces of the individual channel 20 are aligned in the paper width direction to thereby form an individual channel row 7; in the head unit 11, two individual channel rows 7 are arranged side by side in the conveyance direction.

Moreover, in the head unit 11, in a case that the pumps 51 and 52 are driven, the ink inside the ink tank 50 is supplied from the supply channel 46 to the common channel 45. Further, the ink inside the common channel 45 is discharged from the discharge channel 47 and returns to the ink tank 50. With this, the ink is circulated between the common channel 45 and the ink tank 50. Here, in the present embodiment, although the ink is fed by the two pumps 51 and 52, it is allowable that only one of the pumps 51 and 52 is provided. Also in this case, by driving one of the pumps 51 and 52, it is possible to circulate the ink in a similar manner as that described above.

Effects

In the present embodiment, the one common channel 45 is provided with respect to the two individual channel rows 7; the one supply port 46*a* and the one discharge port 47*a* are provided on the one common channel 45. Namely, the one supply port 46*a* and the one discharge port 47*a* are provided with respect to the two individual channel rows 7. With this, the number of the supply port 46 and the number of the discharge port 47*a* are small, as compared with a case wherein the supply ports and the discharge ports are each provided individually with respect to the individual channel rows, respectively, thereby making it possible to simplify the configuration of the channels connected to the common channel 45. Further, the volume of the common channel 45 is increased as compared with a case wherein the common channels are provided individually with respect to the individual channel rows 7, respectively, thereby making it possible to secure the compliance of the common channel 45.

Furthermore, in such a case wherein the common channels are provided individually with respect to the respective individual channel rows 7, respectively, and the supply ports and the discharge ports are each provided individually with respect to the individual channel rows 7, respectively, the head unit is consequently provided with a plurality of supply ports and a plurality of discharge ports. In such a case, in order to avoid any interference between the flow channels connected to the plurality of supply ports and any interference between the flow channels connected to the plurality of discharge ports, it is necessary that the supply ports, the discharge ports, and the supply ports and the discharge ports are arranged to be apart from one another to a certain extent. Therefore, the degree of freedom in arranging the supply ports and the discharge ports is low. In contrast, in the present embodiment, the head unit 11 is provided with one piece of the supply port 46*a* and one piece of the discharge port 47*a*, and thus the degree of freedom in arranging the supply port 46*a* and the discharge port 47*a* is high, as compared with the above-described case.

Moreover, the common channel 45 of the present embodiment extends in the paper width direction, over the entire length of the two pressure chamber rows 8 (two individual channel rows 7). With this, the length in the paper width direction of the common channel 45 is made to be long, thereby making it possible to secure the volume of the common channel 45.

Further, the supply port 46*a* of the present embodiment is arranged in the right end part in the paper width direction of the ceiling surface 45*a* of the common channel 45. Furthermore, the discharge port 47*a* is arranged in the left end part in the paper width direction of the ceiling surface 45*a* of the common channel 45. Moreover, the ceiling surface 45*a* of the common channel 45 is inclined with respect to the horizontal plane upward as approaching from the right side toward the left side in the paper width direction. Any air bubble(s) of the ink, flowing from the supply ports 46*a* into the common channel 45, flow easily along the ceiling surface 45*a* of the common channel 45 toward the discharge port 47*a*. With this, any air bubbles inside the common channel 45 can be discharged efficiently.

Further, when the ink flows in the inside the common channel 45 from the supply port 46*a* to the discharge port 47*a*, the ink flows from the right end part to the left end part in the paper width direction of the common channel 45, over the entire length in the paper width direction, and thus the ink can be circulated efficiently. Furthermore, any air bubbles inside the common channel 45 can be discharged in an ensured manner.

In such a case, unlike the present embodiment, that there is a part extending horizontally is present in the channel connecting the common channel 45 and each of the pressure chamber 40, air bubbles easily accumulate (remain) in this horizontally extending part. Further, the air bubbles easily flow into the pressure chamber 40 from the horizontally extending part. In view of this situation, in the present embodiment, each of the pressure chambers 40 and the common channel 45 overlap with each other in the up-down direction, and the throttle 43 extending in the up-down direction connects each of the pressure chambers 40 and the common channel 45 with each other. In other words, there is no channel which extends horizontally between each of the pressure chambers 40 and the common channel 45, due to which the air bubbles are less likely to flow into each of the pressure chambers 40.

Further, in the present embodiment, the dampers 38*a* of the plate 38 form the lower inner wall surface of the common channel member 39. With this, each of the dampers 38*b* elastically deforms to thereby suppress any fluctuation in the pressure of the ink inside the common channel 45; as a result, it is possible to stabilize the discharge characteristic (performance) of the ink from the nozzles 10.

Furthermore, in the present embodiment, the common channel member 39 provided with the common channel 45 is arranged at the location above the protective substrate 35, and the driver IC 36 is arranged on the upper surface of the protective substrate 35. Accordingly, the driver IC 36 can be cooled with the ink flowing through the common channel 45.

Moreover, in the present embodiment, the plate 38 forming the lower inner wall surface of the common channel 45 is arranged between the driver IC 36 and the common channel member 39 in the up-down direction. Further, in the up-down direction, the heat-conductive plate 29 is interposed between the driver IC 36 arranged in the upper surface of the protective substrate 35 and the plate 38. With this, the heat of the driver IC 36 can be conducted to the common channel 45 efficiently.

Further, in the present embodiment, the driver IC 36 overlaps, in the up-down direction, with the supply channel 46 (supply port 46*a*) and the discharge channel 47 (discharge port 47*a*). With this, the heat conducted from the driver IC 36 to the common channel 45 can be efficiently released to the outside, via the supply channel 46 and the discharge channel 47.

Furthermore, while the ink flows in the inside of the common channel 45 from the supply port 46*a* toward the discharge port 47*a*, the temperature of the ink is increased by the heat of the driver IC 36, etc. Accordingly, in the configuration wherein the discharge port 46*a* is arranged in the right end part and the discharge port 47*a* is arranged in the left end part in the paper width direction of the common channel 45, the temperature of the ink is lower at a part, of the common channel 45, on the tight side in the paper width direction than in a part, of the common channel 45, on the left side in the paper width direction. In the present embodiment, the wiring member 49 is drawn to the right side in the paper width direction. With this, the wiring member 49 can be cooled efficiently by the ink of which temperature is low at the part, of the common channel 45, on the right side in the paper width direction.

Modifications

In the foregoing, the embodiment of the present disclosure has been explained. The present disclosure, however, is not limited to or restricted by the above-described embodiment; a variety of kinds of changes are possible, within the range described in the claims.

In the above-described embodiment, the wiring member 49 is drawn to the right side in the paper width direction (side of the supply port 46*a*). The present disclosure, however, is not limited to this configuration. The wiring member 49 may be drawn to the left side in the paper width direction (side of the discharge port 47*a*), or may be drawn to the both sides in the paper width direction. Alternatively, the wiring member 49 may be drawn in the conveyance direction.

Further, in the above-described embodiment, the driver IC 36 overlaps, in the up-down direction, with both of the supply channel 46 and the discharge channel 47. The present disclosure, however, is not limited to this configuration. The driver IC 36 may overlap with only either one of the supply channel 46 and the discharge channel 47 in the up-down direction. Furthermore, it is allowable that the driver IC 36 does not overlap with none of the supply channel 46 and the discharge channel 47 in the up-down direction.

Moreover, in the above-described embodiment, the plate 38 is provided with the part which makes contact with the driver IC 36 via the heat-conductive plate 29 and the two dampers 38*b* arranged on the both sides, respectively, in the paper width direction of the part. The present disclosure, however, is not limited to this configuration. For example, the plate 38 may be provided with only either one of the two dampers 38*b*. Further, instead of the plate 38, it is allowable to provide, as a member forming the lower inner wall surface of the common channel 45, a member which makes contact with the driver IC 36 via the heat-conductive plate 29 and which is not provided with any damper (corresponding to a "wall member" of the present disclosure). Alternatively, instead of the plate 38, it is allowable to provide, as the member forming the lower inner wall surface of the common channel 45, a member which has a damper extending over the entire length in the conveyance direction of the common channel and which does not make contact with the driver IC 36 via the heat-conductive plate (corresponding to a "damper member" of the present disclosure).

Further, in the present disclosure, the driver IC 36 has such a configuration that the driver IC 36 makes contact with the plate 37 via the heat-conductive plate 29. The present disclosure, however, is not limited to this configuration.

Figure 6:
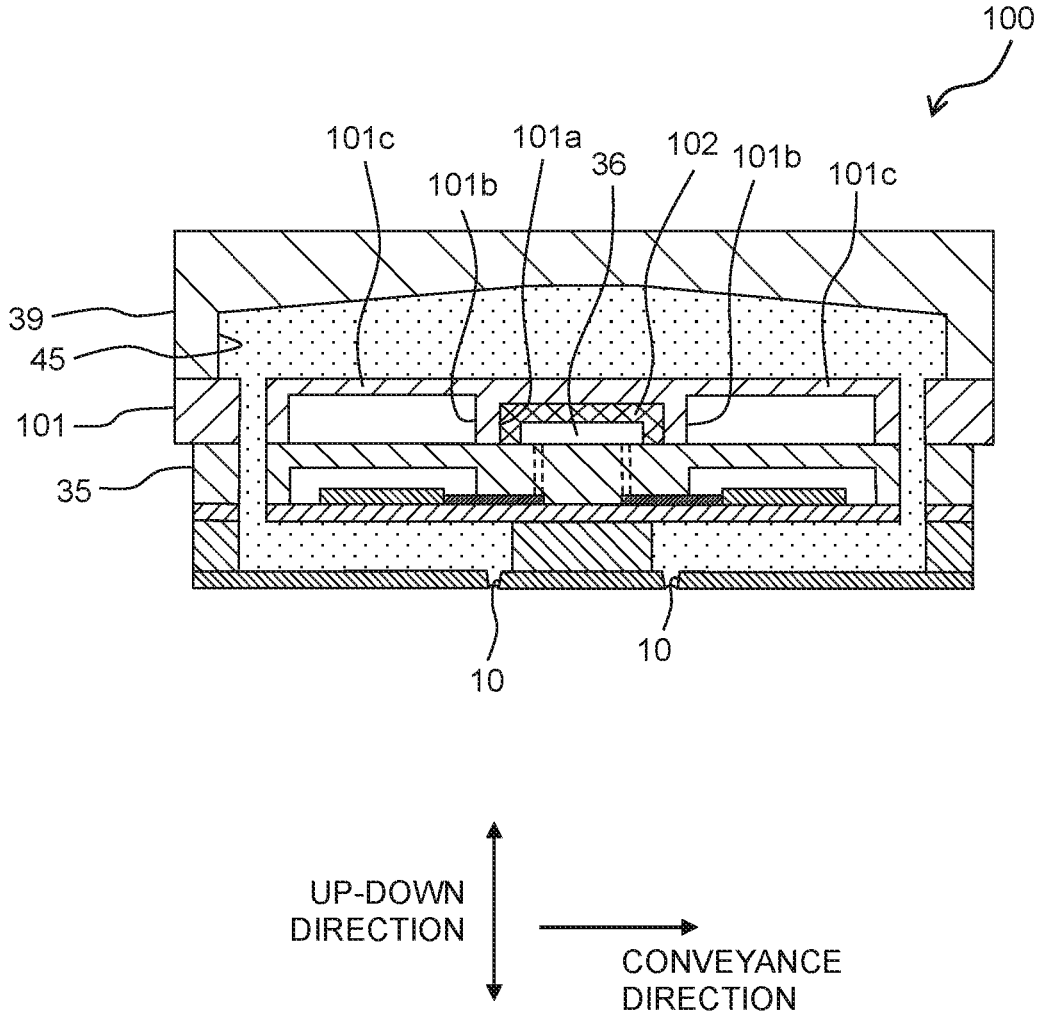
FIG. 6 is a cross-sectional view of a head unit of a first modification, corresponding to FIG. 4.

For example, in a head unit 100 of a first modification, the plates 37 and 38 in the head unit 11 are replaced by one plate 101, as depicted in FIG. 6. The plate 101 is formed with a recessed part 101*a* which is located at a central part in the conveyance direction of the plate 101, which is opened in the lower surface of the plate 101, and which covers the driver IC 36. Further, a heat-conductive grease 102 (corresponding to a "heat-conductive member" of the present disclosure) which fills a gap between the recessed part 101*a* and the driver IC 36 is filled inside the recessed part 101*a*, and the driver IC 36 is covered by the heat-conductive grease 102.

Further, recessed parts 101*b* which are open in the lower surface of the plate 101 are formed respectively at parts of the plate 101 located on the both sides in the conveyance direction of the recessed part 101*a*. With this, parts or portions, of the plate 101, which are located above the recessed part 101*a* are dampers 101*a* of which thicknesses are thinned and which are elastically deformable. Further, the recessed parts 101*b* are damper chambers each of which is a space for receiving downward elastic deformation of one of the dampers 101*c*.

Note that in the first modification, the plate 101 forming the lower inner wall surface of the common channel 45 has the part making contact with the driver IC 36 via the heat-conductive grease 102 (the part located above the recessed part 101*a*; corresponding to the "wall member" of the present disclosure) and the dampers 101*a* (corresponding to the "damper member" of the present disclosure). Namely, in the present modification, the plate 101 corresponds to the "wall member" and the "two damper members" of the present disclosure which are combined as an integrated body.

Further, in the first modification, the plate 101 which becomes the lower wall of the common channel 45 is arranged between the protective substrate 35 and the common channel member 39 in the up-down direction. Furthermore, the recessed part 101*a* is formed in the lower part of the plate 101, and the driver IC 36 is arranged in the inside of the recessed part 101*a*. Moreover, in the inside of the recessed part 101*a*, the gap between the driver IC 36 and the recessed part 11*a* is filled with the heat-conductive grease 102. With this, the heat of the driver IC 36 can be conducted to the common channel 45 efficiently.

Further, in the first modification, the plate 101 which is arranged between the protective substrate 35 and the common channel member 39 in the up-down direction is provided with the part making contact with the heat-conductive grease 102 (the part located above the recessed part 101*a*) and the two dampers 101*a* arranged on the both sides, respectively, in the conveyance direction of this part. With this, it is possible to conduct the heat of the driver IC 36 to the common channel 46 efficiently, while suppressing any fluctuation or variation in the pressure of the ink inside the common channel 45.

Figure 7:
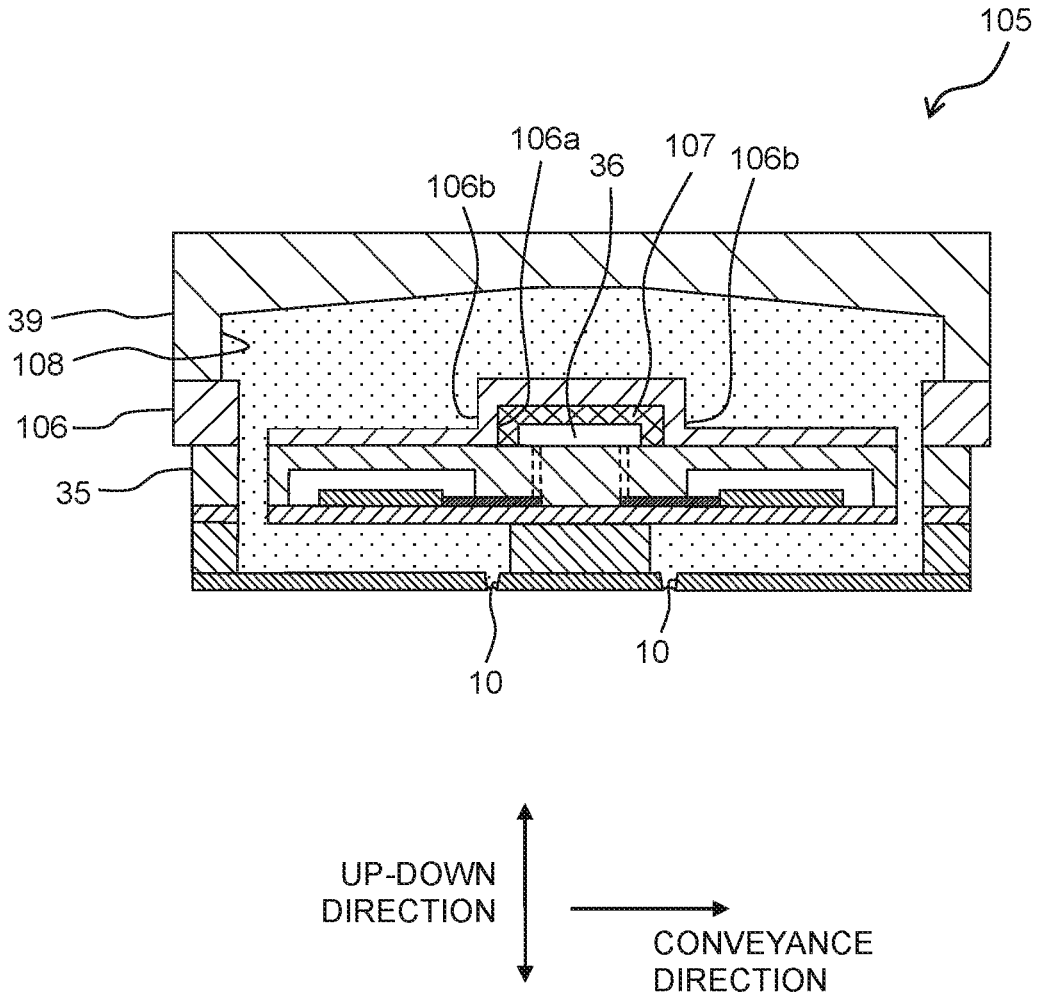
FIG. 7 is a cross-sectional view of a head unit of a second modification, corresponding to FIG. 6.

In a head unit 105 of a second modification, the plates 37 and 38 in the head unit 11 are replaced by one plate 106, as depicted in FIG. 7. The plate 101 is formed with a recessed part 106*a* which is located at a central part in the conveyance direction of the plate 106, which is opened in the lower surface of the plate 106, and which covers the driver IC 36. Further, a heat-conductive grease 107 (corresponding to the "heat-conductive member" of the present disclosure) which fills a gap between the recessed part 106*a* and the driver IC 36 is filled inside the recessed part 106*a*, and the driver IC 36 is covered by the heat-conductive grease 107.

Furthermore, recessed parts 106*b* which are open in the upper surface of the plate 106 are formed respectively at parts of the plate 106 located on the both sides in the conveyance direction of the recessed part 106*a*. With this, a common channel 108 of the second modification has a part formed of the common channel member 39 and parts formed of (defined by) the recessed parts 106*b*, and the common channel 108 has a larger volume than that of the common channel 45 of the above-described embodiment. Further, since the volume of the common channel 108 is large in the second modification, the heat radiating (heat dissipating) performance from the driver IC 36 to the common channel 108 is high. Note that in the case of the second modification, there is no part which is to be the damper in the lower surface of the common channel 108.

Note that in the first and second modifications, it is allowable that any heat-conductive grease which fills the gap between the driver IC 36 and the recessed part 101*a*, 106*a* is not filled in the inside of the recessed part 101*a*, 106*a* in which the driver IC is accommodated. For example, it is allowable that the driver IC 36 makes contact directly with an upper inner wall surface of the recessed part 101*a*, 106*a*.

Further, in the above-described embodiment and first modification, the driver IC 36 is arranged on the upper surface of the protective substrate 35. The present disclosure, however, is not limited to this configuration. For example, it is allowable that the driver IC 36 is arranged on a part, on the upper surface of the vibration plate 33, which is located between the two pressure chamber rows 8.

Furthermore, in the above-described embodiment, the pressure chambers 40 and the common channel 45 are overlapped in the up-down direction, and each of the throttles 43 extending in the up-down direction connects one of the pressure chambers 40 to the common channel 45. The present disclosure, however, is not limited to this configuration. For example, it is allowable that another channel having the different configuration from that of the channel described above connect each of the pressure chambers 40 to the common channel 45. Moreover, in such a case, the another channel connecting each of the pressure chambers 40 and to common channel 45 may have a part extending horizontally.

Further, in the above-described embodiment, the supply port 46*a* is arranged in the central part in the conveyance direction of the right end part in the paper width direction of the ceiling surface 45*a* of the common channel 45, and the discharge port 47*a* is arranged in the central part in the conveyance direction of the left end part in the paper width direction of the ceiling surface 45*a* of the common channel 45. The present disclosure, however, is not limited to this configuration.

Figure 8:
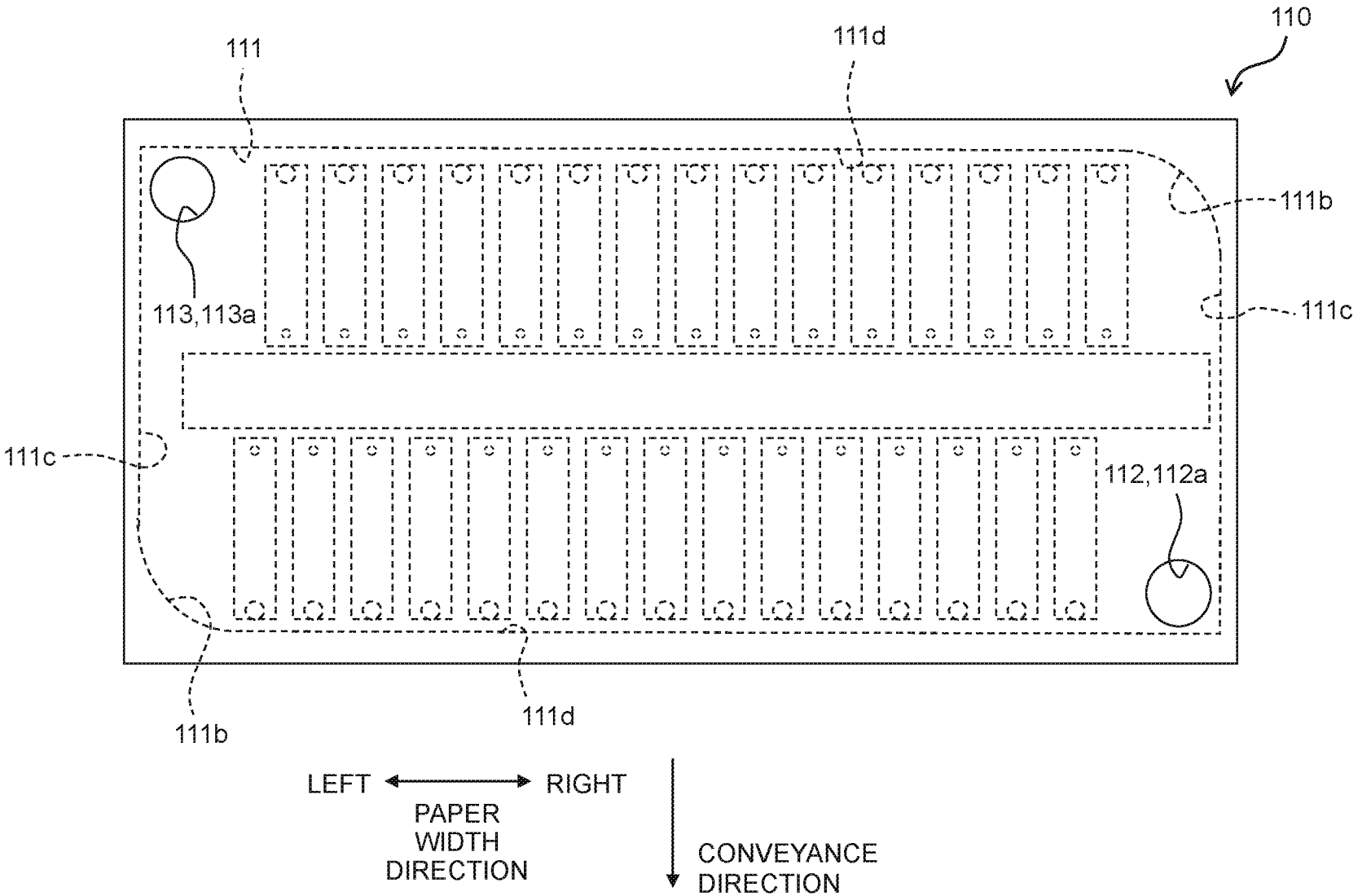
FIG. 8 is a plan view of a head unit of a third modification, corresponding to FIG. 3.
Figure 9:
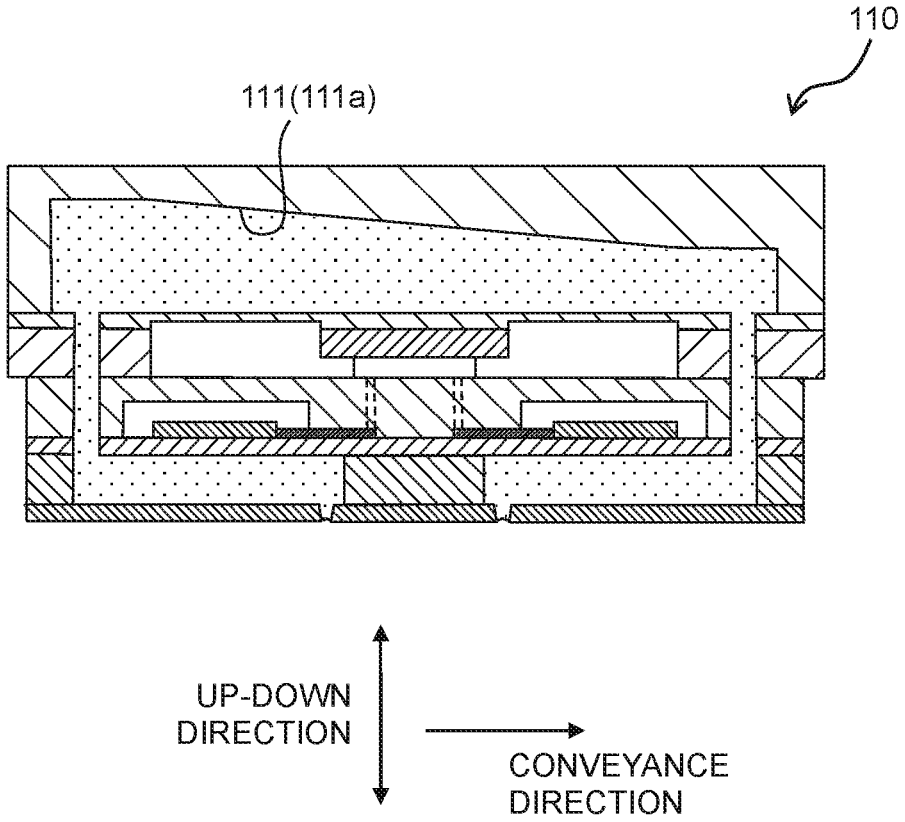
FIG. 9 is a cross-sectional view of the head unit of the third modification, corresponding to FIG. 4.
Figure 10:
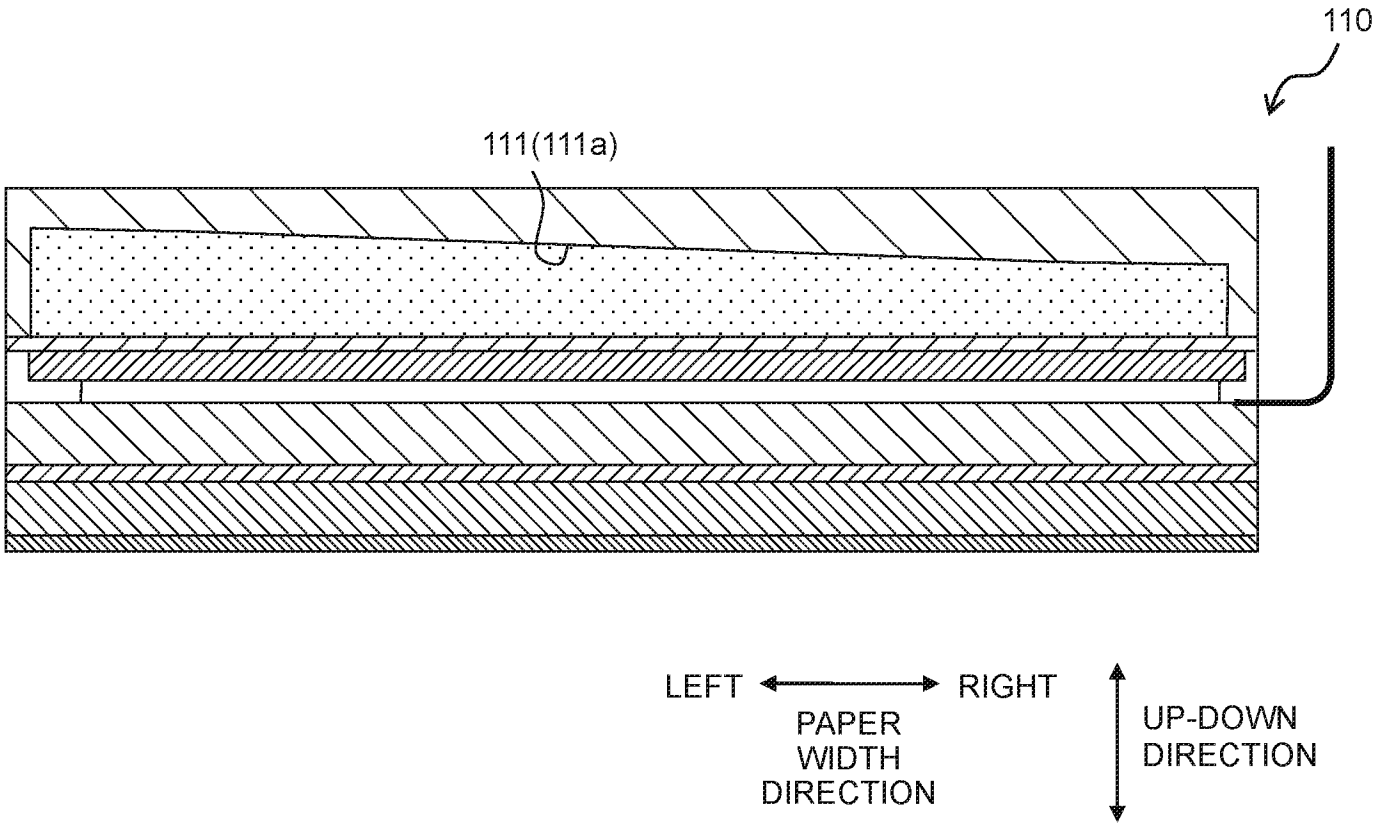
FIG. 10 is a cross-sectional view of the head unit of the third modification, corresponding to FIG. 5.

In a head unit 110 of a third modification, as depicted in FIGS. 8 to 10, the shape, of a common channel 111, as viewed in the up-down direction is a rectangle which is long in the paper width direction. Further, a supply port 112*a* of a supply channel 112 is arranged in a corner part, of a ceiling surface 111*a* of the common channel 111, on the right side in the paper width direction and on the downstream side in the conveyance direction. Furthermore, a discharge port 113*a* of a discharge channel 113 is arranged in a corner part, of the ceiling surface 111*a* of the common channel 111, which is located on the left side in the paper width direction and on the upstream side in the conveyance direction. Namely, in the second modification, the supply ports 112*a* and the discharge port 113*a* are arranged, respectively, at two corner parts, of the ceiling surface 111*a* of the common channel 111, which correspond to diagonal corners of the rectangle.

Moreover, in the third modification, a side wall surface, of the common channel 111, in a corner part which is located on the right side in the paper width direction and on the upstream side in the conveyance direction, and a side wall surface, of the common channel 111, in a corner part which is located on the left side in the paper width direction and on the downstream side in the conveyance direction (two corner parts in which the supply port 112*a* and the discharge port 113*a* are not arranged) are curved surfaces 111*b* which are curved so as to project toward outside of the common channel 111. Further, the curved surfaces 111*b* connect side wall surfaces 111*c* extending in the conveyance direction and side wall surfaces 111*d* extending in the paper width direction to one another.

Further, in the third modification, the ceiling surface 111*a* of the common channel 111 is inclined with respect to a horizontal plane upward as approaching from the right side toward the left side in the paper width direction, and the ceiling surface 111*a* of the common channel 111 is inclined with respect to the horizontal plane upward as approaching from the downstream side toward the upstream side in the conveyance direction.

Furthermore, in the third modification, since the ceiling surface 111*a* of the common channel 111 is inclined with respect to the horizontal plane as described above, any air bubbles in the ink inside the common channel 111 flow easily along the ceiling surface 111*a* from the supply port 112*a* toward the discharge port 113*a*, and can be easily discharged from the discharge port 113*a*.

Moreover, in the third modification, the side wall surfaces 111*c* and the side wall surfaces 111*d* are connected by the curved surfaces 111*b* to one another at the two corner parts, of the common channel 111 of which shape as viewed in the up-down direction is the rectangle, wherein the supply port 112*a* and the discharge port 113*a* are not arranged. With this, in such a case that any air bubbles are present in these two corner parts, the air bubbles easily flow toward the side wall surface 111*c* or the side wall surface 111*d* via the curved surface 111*b*, and thus the air bubbles are less likely to remain (accumulate) in these corner parts.

Further, in the third modification, the side wall surfaces, of the common channel 111, at the two corner parts, respectively, in which the supply port 112*a* and the discharge port 113*a* are not arranged, are the curved surfaces 111*b* connecting the side wall surfaces 111*c* and the side wall surfaces 111*d* to one another. The present disclosure, however, is not limited to this configuration. It is allowable that side wall surfaces 111*c* extending in the conveyance direction and side wall surfaces 111*d* extending in the paper width direction are directly connected to one another at the two corner parts, of the common channel 111, in which the supply port 112*a* and the discharge port 113*a* are not arranged.

Figure 11:
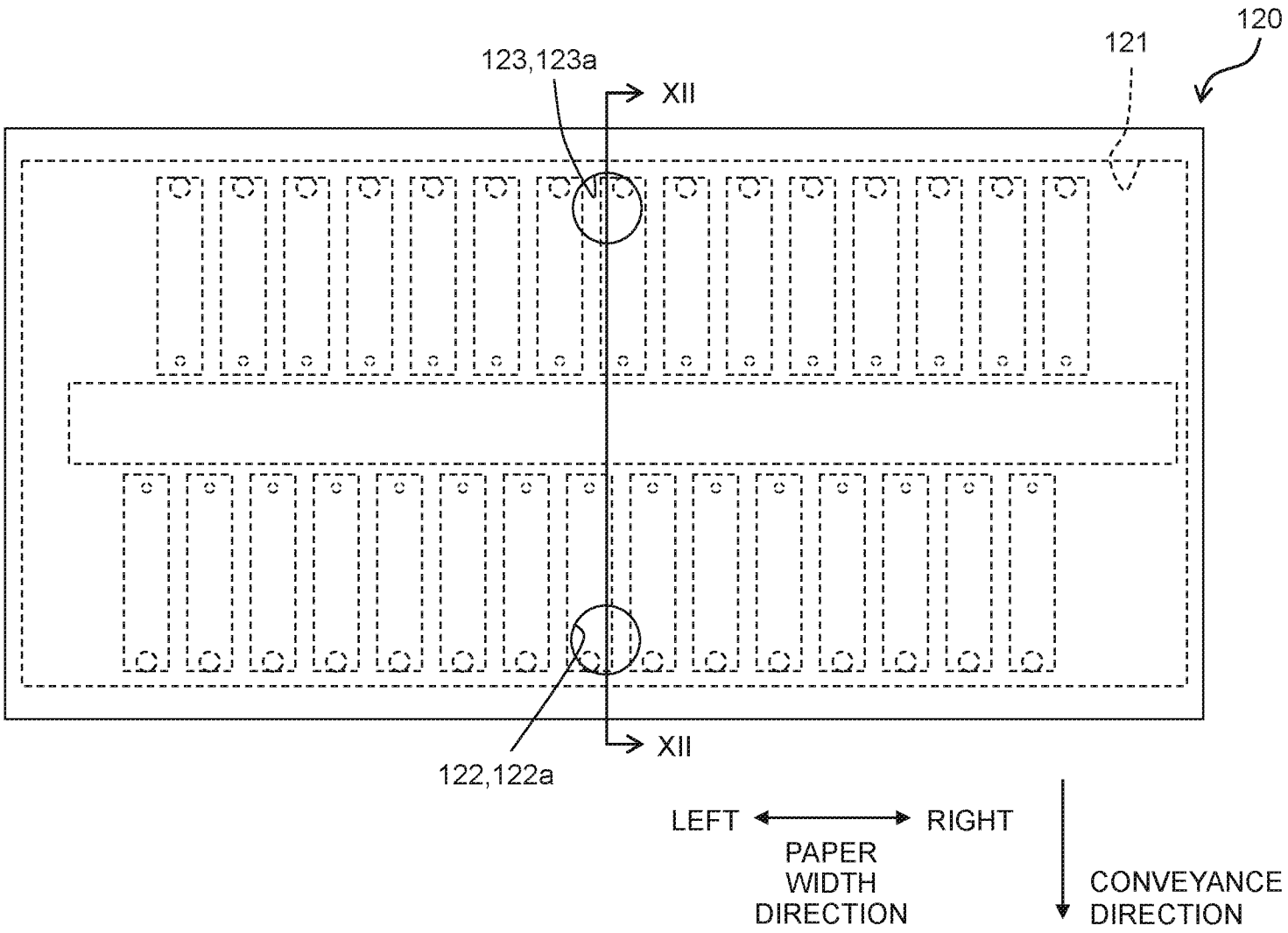
FIG. 11 is a plan view of a head unit of a fourth modification, corresponding to FIG. 3.
Figure 12:
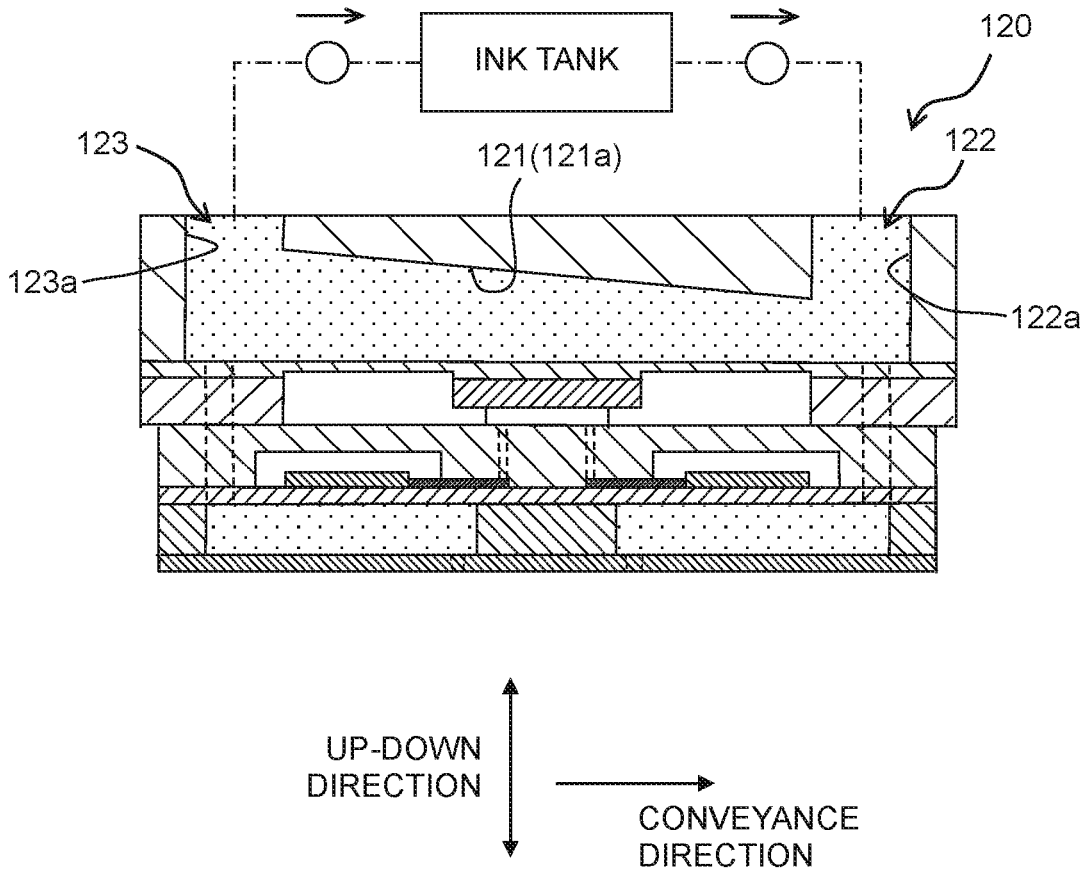
FIG. 12 is a cross-sectional view taken along a line XII-XII in FIG. 11.
Figure 13:
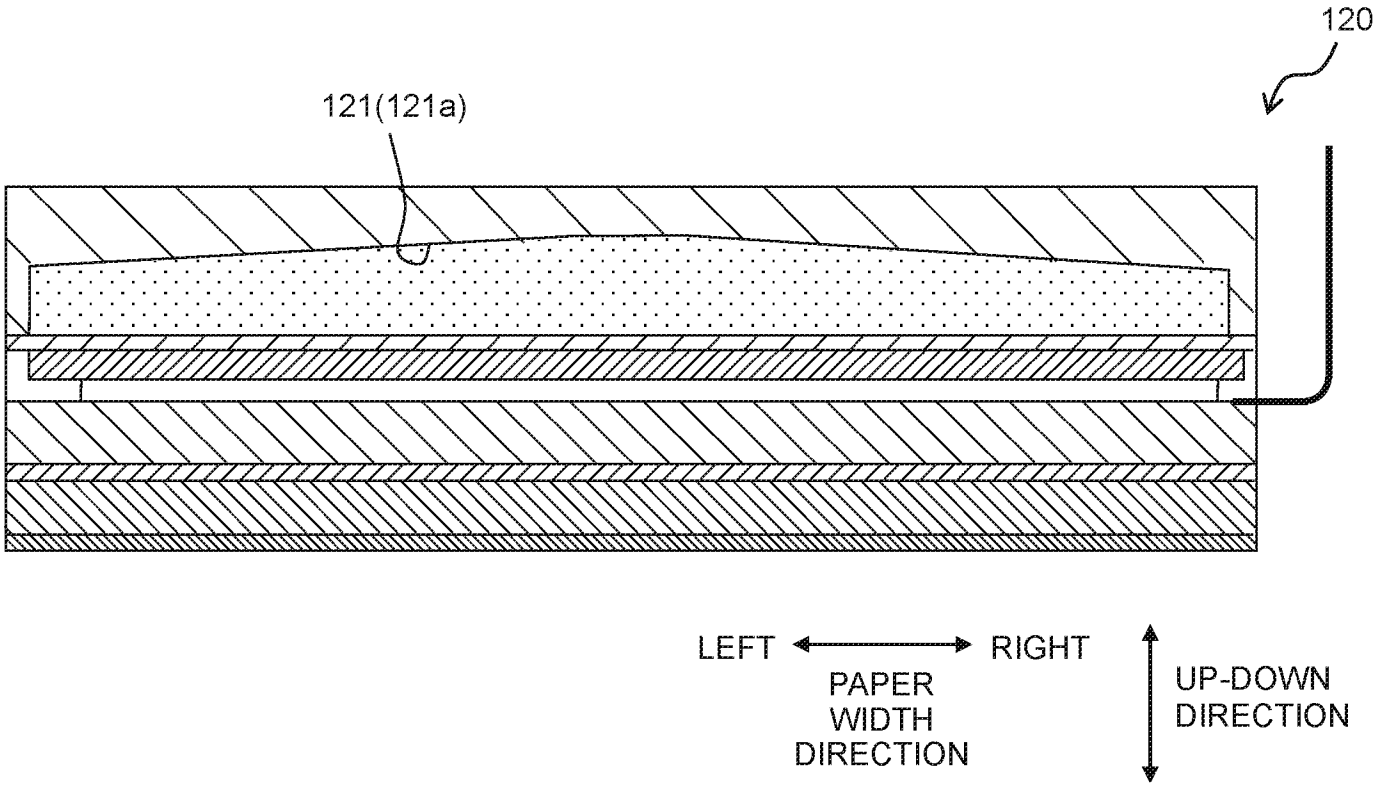
FIG. 13 is a cross-sectional view of the head unit of the fourth modification, corresponding to FIG. 5.

In a head unit 120 of a fourth modification, as depicted in FIGS. 11 to 13, a supply port 122*a* of a supply channel 122 is arranged in a central part in the paper width direction of an end part on the downstream side in the conveyance direction of a ceiling surface 121*a* of a common channel 121; further, a discharge port 123*a* of a discharge channel 123 is arranged in a central part in the paper width direction of an end part on the upstream side in the conveyance direction of the ceiling surface 121*a* of the common channel 121.

Furthermore, in the fourth modification, the ceiling surface 121*a*, of the common channel 121 is inclined with respect to a horizontal plane upward as approaching from the downstream side toward the upstream side in the conveyance direction, and the ceiling surface 121*a* is inclined with respect to the horizontal plane upward as approaching from the outer side toward the inner side in the paper width direction of the head unit 120.

Moreover, in the case of the fourth modification, the ceiling surface 121*a* of the common channel 121 is inclined with respect to the horizontal plane as described above, any air bubbles in the ink inside the common channel 121 flow easily along the ceiling surface 121*a* from the supply port 122*a* toward the discharge port 123*a*, and can be easily discharged from the discharge port 123*a*.

Further, in the fourth modification, since the distance between the supply port 122*a* and the discharge port 123*a* is short, the channel resistance of the flow through the common channel 121 from the supply port 122*a* toward the discharge port 123 can be made small. Since the channel resistance is small, the pressure, which is applied to the ink by the pumps 51 and 52 for the purpose of making the pressure of the ink inside the nozzle 10 to be a desired pressure, can be made small. With this, in a case of driving the pumps 51 and 52 to thereby make the pressure of the ink, in each of the respective parts or portions in the channel to be the desired pressure, it is possible to cause the pressure to reach the desired pressure in a short period of time, without destroying the meniscus of the ink.

Figure 14:
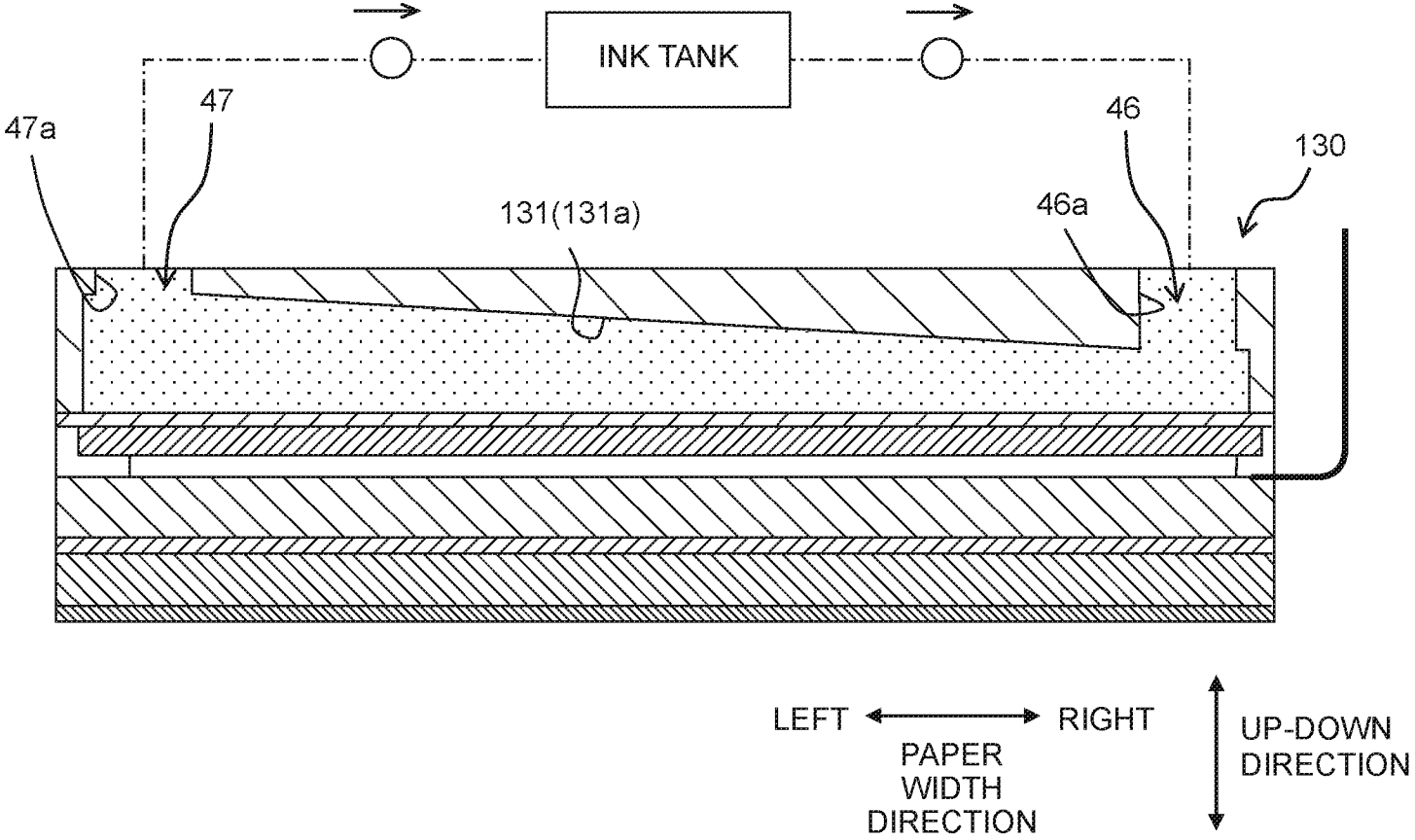
FIG. 14 is a cross-sectional view of a head unit of a fifth modification, corresponding to FIG. 5.

Moreover, in the above-described embodiment, the inclination angle, of the ceiling surface of the common channel, with respect to the paper width direction or the conveyance direction is constant. The present disclosure, however, is not limited to this configuration. For example, in a head unit 130 of a fifth modification, the common channel 45 in the head unit 11 is replaced by a common channel 131, as depicted in FIG. 14. A ceiling surface 131*a* of the common channel 131 is inclined, with respect to a horizontal plane, upward as approaching from the right side toward the left side in the paper width direction (as approaching from the side of the supply port 46*a* toward the side of the discharge port 47*a*). Further, the ceiling surface 131*a* of the common channel 131 is curved such that the inclination angle of the ceiling surface with respect to the horizontal surface 131*a* becomes greater as approaching closer to the discharge port.

Further, in the case of the fifth modification, the ceiling surface 131*a* of the common channel 131 is inclined with respect to the horizontal plane as described above, any air bubbles in the ink inside the common channel 131 flow easily along the ceiling surface 131*a* from the supply port 46*a* toward the discharge port 47*a*, and can be easily discharged from the discharge port 47*a*.

The supply port of the supply channel and the discharge port of the discharge channel may be arranged in parts, respectively, of the ceiling surface of the common channel, which are different from those as described above. In such a case also, under a condition that the ceiling surface of the common channel is inclined with respect to the horizontal plane upward as approaching from the supply port toward the discharge port, any air bubbles in the ink inside the common channel flow easily along the ceiling surface from the supply port toward the discharge port, and can be easily discharged from the discharge port.

Moreover, the ceiling surface of the common channel is not limited to being inclined with respect to the horizontal plane upward as approaching from the supply port toward the discharge port. For example, the ceiling surface of the common channel may be a horizontal surface.

Further, in the above-described embodiment and modifications, the supply port of the supply channel and the discharge port of the discharge channel are arranged in the ceiling surface of the common channel. However, the present disclosure is not limited to this configuration. The supply port of the supply channel and the discharge port of the discharge channel may be arranged in parts, respectively, of the common channel, which are different from the ceiling surface of the common channel as described above, such as a side wall surface of the common channel, etc.

Furthermore, in the above-described embodiment, the common channel 45 extends, in the paper width direction, over the entire length of the area wherein the plurality of pressure chambers 40 constructing the two pressure chamber rows 8 are arranged. The present disclosure, however, is not limited to this configuration. In the paper width direction, the common channel may overlap, in the up-down direction, with only a part of the plurality of pressure chambers 40 constructing the two pressure chamber rows 8. Note that in such a case, a channel connecting the common channel to each of pressure chambers which are included in the plurality of pressure chambers 40 and which do not overlap with the common channel in the up-down direction may be a channel having a part extending in the paper width direction.

Further, although the foregoing explanation has been given about the example wherein the head unit is provided with the two individual channel rows, the present disclosure is not limited to this configuration. The head unit may be provided with not less than three individual channel rows arranged side by side in the conveyance direction. In such a case, it is allowable that the head unit includes one common channel communicating with the plurality of individual channels constructing the not less than three individual channel rows. Furthermore, the common channel may be configured such that the common channel overlaps in the up-down direction with the not less than three individual channel rows, and extends in the conveyance direction over the entire length of the area in which the not less than three individual channel rows are arranged.

Further, although the foregoing explanation has been given about the example wherein the present disclosure is applied to the head unit which discharges the ink from the nozzles, the present disclosure is not limited to this configuration. For example, it is also possible to apply the present disclosure to a liquid discharge head which is configured to discharge a liquid different from the ink, for example, a liquified resin or metal, etc., from the nozzle(s).

What is claimed is:

1. A liquid discharge head comprising:

at least two individual channel rows, each of the at least two individual channel rows being formed of individual channels aligned lengthwise in a first direction, each of the individual channels including a nozzle and a pressure chamber communicating with the nozzle, and the at least two individual channel rows being spaced widthwise in a second direction crossing the first direction;

a common channel extending in the first direction, the common channel overlapping with the individual channel rows in a third direction orthogonal to both of the first and second directions, the common channel extending in the second direction over an entire length and width of an area in which the individual channel rows are arranged, the common channel communicating with the individual channels constructing each of the individual channel rows;

a supply port via which liquid is supplied to the common channel;

a discharge port via which the liquid is discharged from the common channel;

a pressure chamber member formed with the pressure chamber;

a vibration plate arranged on the pressure chamber member;

a common channel member formed with the common channel and stacked with respect to the pressure chamber member in the third direction;

an actuator arranged on the vibration plate and configured to apply pressure to the liquid inside the pressure chamber;

a protective member arranged between the vibration plate and the common channel member in the third direction and covering the actuator, and a driver IC arranged between the protective member and the common channel member in the third direction, and configured to drive the actuator.

2. The liquid discharge head according to claim 1, wherein the common channel extends in the first direction over an entire length of the individual channel rows.

3. The liquid discharge head according to claim 1, wherein each of the first direction and the second direction is a direction along a horizontal plane, the third direction is a vertical direction, the common channel is located above the individual channel rows, the supply port and the discharge port are arranged in a ceiling surface of the common channel, and the ceiling surface of the common channel is inclined, with respect to the horizontal plane, upward as approaching from the supply port toward the discharge port.

4. The liquid discharge head according to claim 3, wherein the supply port is arranged in an end part, of the ceiling surface of the common channel, on one side in the first direction, the discharge port is arranged in an end part, of the ceiling surface of the common channel, on the other side in the first direction, and the ceiling surface of the common channel is inclined, with respect to the horizontal plane, upward as approaching from the one side toward the other side in the first direction.

5. The liquid discharge head according to claim 4, wherein a shape, of the common channel, as viewed in the third direction is a rectangle which is long in the first direction, the supply port is arranged in a corner part which is included in two corner parts located in a diagonal of the rectangle in the common channel and which is located on the one side in the first direction, and the discharge port is arranged in a corner part which is included in the two corner parts and which is located on the other side in the first direction.

6. The liquid discharge head according to claim 5, wherein the common channel has:

a first side wall surface extending in the first direction;

a second side wall surface extending in the second direction; and a curved surface connecting the first side wall surface and the second side wall surface and defining a corner part, of the common channel, in which none of the supply port and the discharge port is arranged, and the curved surface projects toward outside of the common channel.

7. The liquid discharge head according to claim 3, wherein the supply port is arranged in an end part, of the ceiling surface of the common channel, on one side in the second direction, the discharge port is arranged in an end part, of the ceiling surface of the common channel, on the other side in the second direction, and the ceiling surface of the common channel is inclined, with respect to the horizontal plane, upward as approaching from the one side toward the other side in the second direction.

8. The liquid discharge head according to claim 3, wherein the ceiling surface of the common channel is curved such that an inclination angle of the ceiling surface with respect to the horizontal plane increases as approaching from the supply port toward the discharge port.

9. The liquid discharge head according to claim 1, wherein each of the first direction and the second direction is a direction along a horizontal plane, the third direction is a vertical direction, the common channel is located above the individual channel rows, and each of the individual channels includes:

a pressure chamber overlapping with the common channel in the third direction and communicating with the nozzle; and a throttle extending in the third direction and connecting in the third direction the pressure chamber and the common channel to each other.

10. The liquid discharge head according to claim 1, further comprising:

a common channel member formed with the common channel; and a damper member forming an inner wall surface, of the common channel, on a side of the individual channel rows in the third direction.

11. The liquid discharge head according to claim 1, further comprising a heat conductive member arranged between the common channel member and the driver IC in the third direction.

12. The liquid discharge head according to claim 11, further comprising a wall member arranged between the common channel member and the protective member in the third direction, and forming an inner wall surface, of the common channel, on a side of the protective member in the third direction, wherein the wall member has a recessed part in a surface thereof on the side of the protective member in the third direction; and the driver IC is accommodated in the recessed part.

13. The liquid discharge head according to claim 12, wherein the heat conductive member is a heat conductive grease, and the heat conductive grease is filled in the recessed part in which the driver IC is accommodated to thereby fill a space between the recessed part and the driver IC with the heat conductive grease and to cover the driver IC with the heat conductive grease.

14. The liquid discharge head according to claim 11, further comprising:

a wall member which forms a part of an inner wall surface, of the common channel, on a side of the protective member in the third direction, and which makes contact with the heat conductive member; and two damper members which are located at both sides in the second direction of the wall member, and each of which forms a part of the inner wall surface, of the common channel, on the side of the protective member in the third direction.

15. The liquid discharge head according to claim 1, wherein the driver IC overlaps with at least one of the supply port and the discharge port in the third direction.

16. The liquid discharge head according to claim 1, wherein the supply port is arranged in an end part, of the common channel, on one side in the first direction, the discharge port is arranged in an end part, of the common channel, on the other side in the first direction; and the liquid discharge head further comprises a wiring member which is connected to the driver IC and which is drawn from a connection part thereof with the driver IC toward the one side in the first direction.

* * * * *